US006536086B2

(12) United States Patent
Liu

(10) Patent No.: US 6,536,086 B2
(45) Date of Patent: Mar. 25, 2003

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,964

(22) Filed: Aug. 3, 2001

(65) Prior Publication Data

US 2003/0024086 A1 Feb. 6, 2003

(51) Int. Cl.[7] ..... A43C 7/00; A43B 11/00; F16G 11/00

(52) U.S. Cl. ..... 24/712.1; 24/713.6; 24/714.1; 24/714.6; 36/50.1

(58) Field of Search ..... 24/712.1, 713.6, 24/714.1, 714.6; 36/50.1

(56) References Cited

U.S. PATENT DOCUMENTS 3,122,805 A * 3/1964 Hakim ..... 24/712.1
4,254,566 A * 3/1981 Haskell ..... 24/713.6
4,342,557 A * 8/1982 Bandar ..... 24/713.6
4,670,949 A * 6/1987 Autry ..... 36/50.1
4,967,454 A * 11/1990 Elieff ..... 24/712.1
5,110,296 A * 5/1992 Cohen ..... 434/260
5,293,675 A * 3/1994 Shai ..... 24/712.1
6,003,214 A * 12/1999 Lee ..... 24/712.1
6,370,743 B2 * 4/2002 Choe ..... 24/712.1

* cited by examiner

*Primary Examiner*—Victor Sakran
(74) *Attorney, Agent, or Firm*—Foley & Lardner

(57) ABSTRACT

A double-bow shoe lace device for a shoe includes six lace sections, a clamp member, and a decorative knot. The lower ends of the first to fourth lace sections are anchored on the eyelet tabs. The upper ends of the first and second lace sections and those of the fifth and sixth lace sections are interconnected to form first and second loops, respectively. The clamp member is sleeved slidably on medial portions of the first and second lace sections. The upper end of at least one of the third and fourth lace sections and the lower ends of the fifth and sixth lace sections are anchored on the clamp member. The decorative knot is secured on and is disposed externally of the clamp member between the first and second loops, and has a knot portion and two distal portions.

13 Claims, 10 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on the shoe body 41 so as to form a criss-cross pattern on the eyelet tabs 5. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe 4 has a shoe lace device 1 that is easy to use, the simple loop configuration of the second lace section 202 has an unattractive appearance.

SUMMARY OF THE INVENTION

Therefore, the main object of the present invention is to provide a double-bow shoe lace device for a shoe.

Accordingly, a double-bow shoe lace device of this invention is adapted for use with a shoe having first and second eyelet tabs. The shoe lace device comprises first, second, third, fourth, fifth and sixth lace sections, a clamp member, and a decorative knot. Each of the six lace sections has a lower end and an upper end. The lower ends of the first and second lace sections are adapted to be anchored on the first eyelet tab. The lower ends of the third and fourth lace sections are adapted to be anchored on the second eyelet tab. The upper ends of the first and second lace sections are interconnected to form a first loop. The upper ends of the fifth and sixth lace sections are interconnected to form a second loop. The clamp member is sleeved slidably on medial portions of the first and second lace sections between the upper and lower ends of the first and second lace sections. The upper end of at least one of the third and fourth lace sections is anchored on the clamp member. The lower ends of the fifth and sixth lace sections are anchored on the clamp member. The decorative knot is secured on and is disposed externally of the clamp member between the first and second loops, and has a knot portion and a pair of distal portions extending from the knot portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
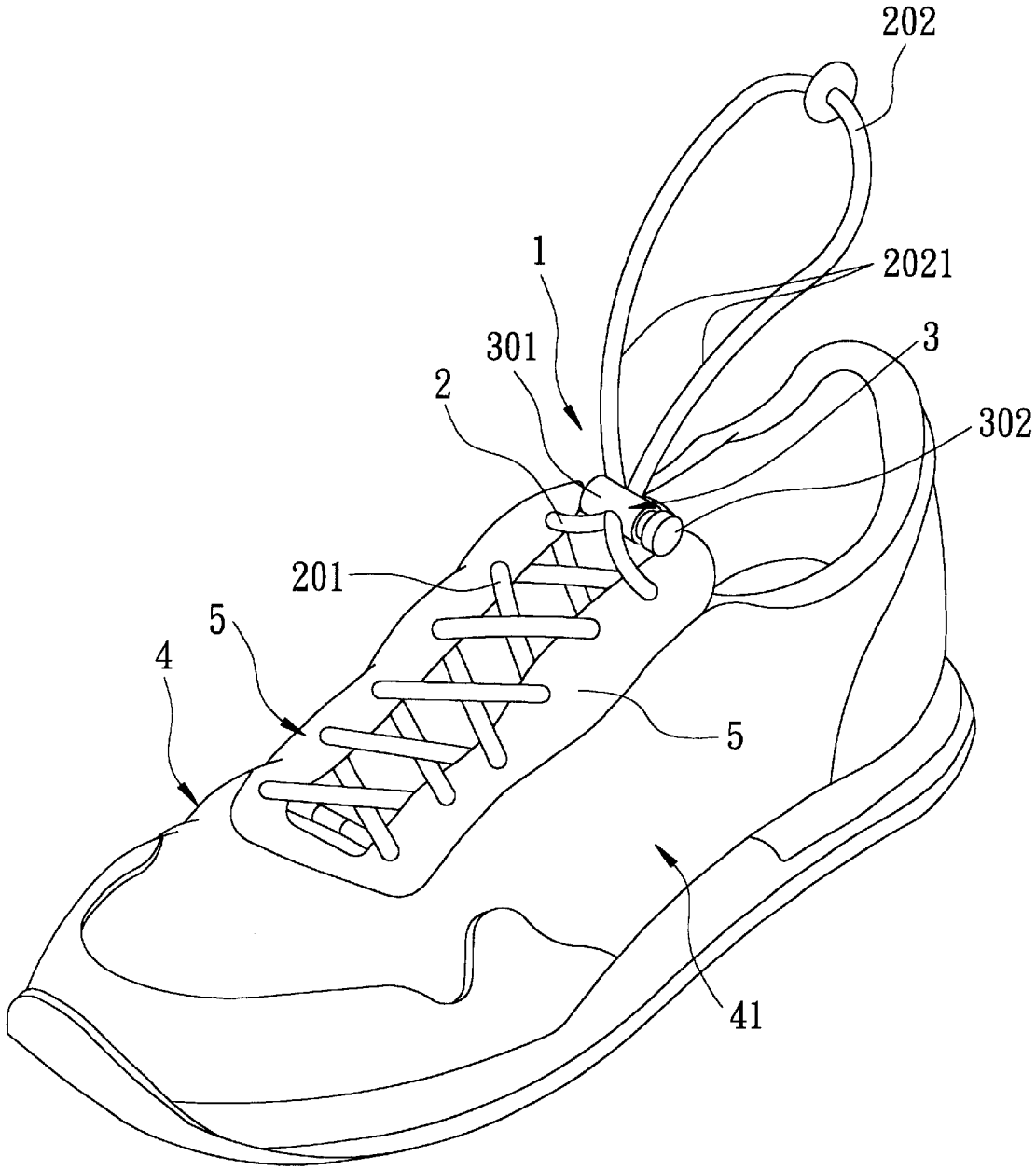
FIG. 1 PRIOR ART
FIG. 1 is is a perspective view of a shoe with a conventional shoe lace device.
Figure 2:
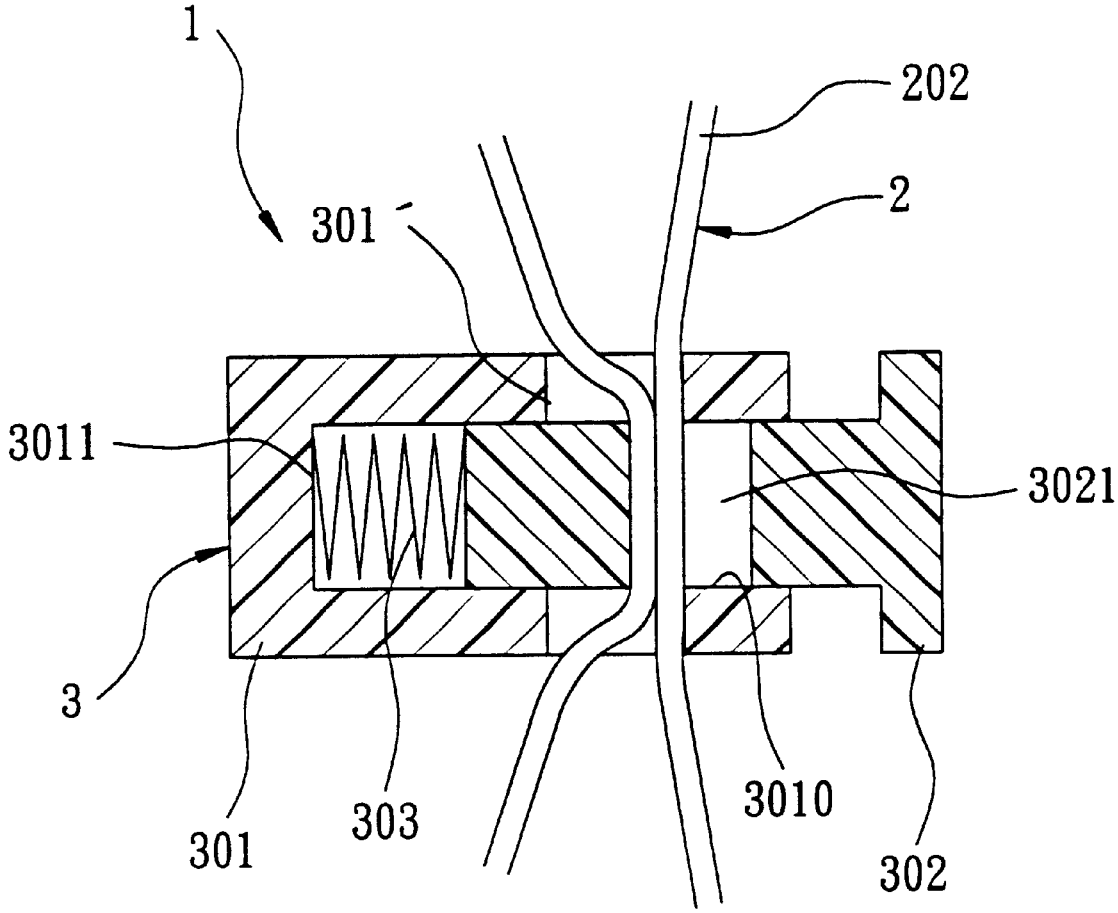
FIG. 2 PRIOR ART
FIG. 2 is a cross-sectional view of a clamp member of the conventional shoe lace device.

Before the present invention is described in greater detail, it should be noted that like elements are denoted by the same reference numerals throughout the disclosure.

Figure 3:
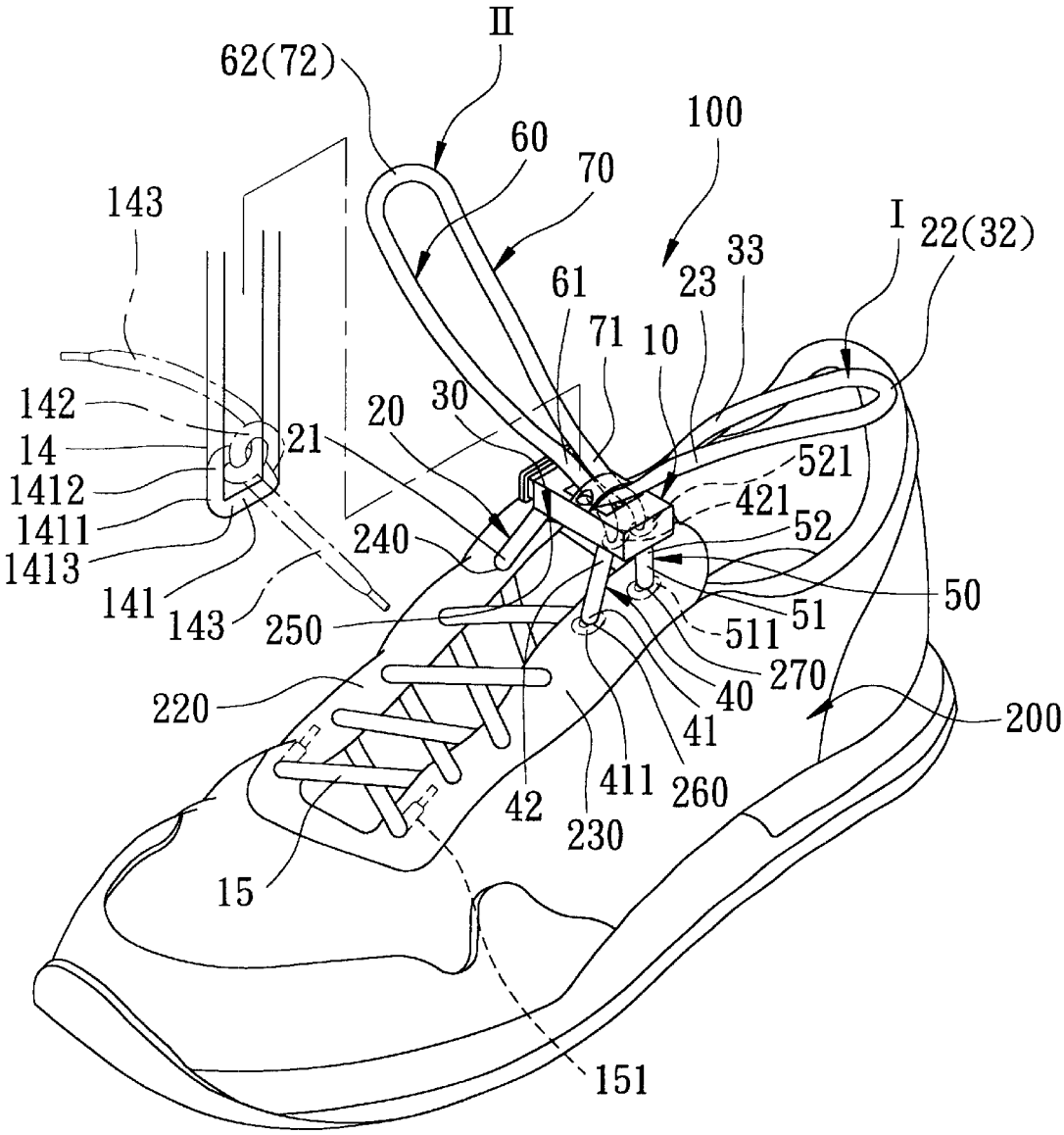
FIG. 3 is a perspective view of a shoe that incorporates the first preferred embodiment of a double-bow shoe lace device according to the present invention.

Referring to FIG. 3, the first preferred embodiment of a double-bow shoe lace device 100 according to the present invention is shown to be adapted for use with a shoe 200 having first and second eyelet tabs 220, 230. The shoe lace device 100 comprises a shoe lace 15, a clamp member 10, and a decorative knot 14. The shoe lace 15 has a first lace segment that is strung on the shoe body 201 in a conventional manner so as to form a criss-cross pattern on the eyelet tabs 220, 230, and a second lace segment that includes first, second, third, fourth, fifth and sixth lace sections 20, 30, 40, 50, 60, 70. The first lace segment has distal ends 151 concealed by the eyelet tabs 220, 230. Each of the six lace sections 20, 30, 40, 50, 60, 70 has a lower end 21, 31, 41, 51, 61, 71, and an upper end 22, 32, 42, 52, 62, 72. The lower ends 21, 31 of the first and second lace sections 20, 30 are adapted to be anchored respectively on first and second eyelets 240, 250 of the first eyelet tab 220. The lower ends 41, 51 of the third and fourth lace sections 40, 50 are formed with a respective knot 411, 511 that is adapted to engage first and second eyelets 260, 270 of the second eyelet tab 230, respectively, thereby anchoring the lower ends 41, 51 on the second eyelet tab 230. The upper ends 22, 32 of the first and second lace sections 20, 30 are interconnected to form a first loop (I). The upper ends 62, 72 of the fifth and sixth lace sections 60, 70 are interconnected to form a second loop (II). In this embodiment, the lower ends 21, 41 of the first and third lace sections 20, 40 are connected to the first lace segment. The lower ends 31, 51 of the second and fourth lace sections 30, 50 are connected to each other.

Figure 4:
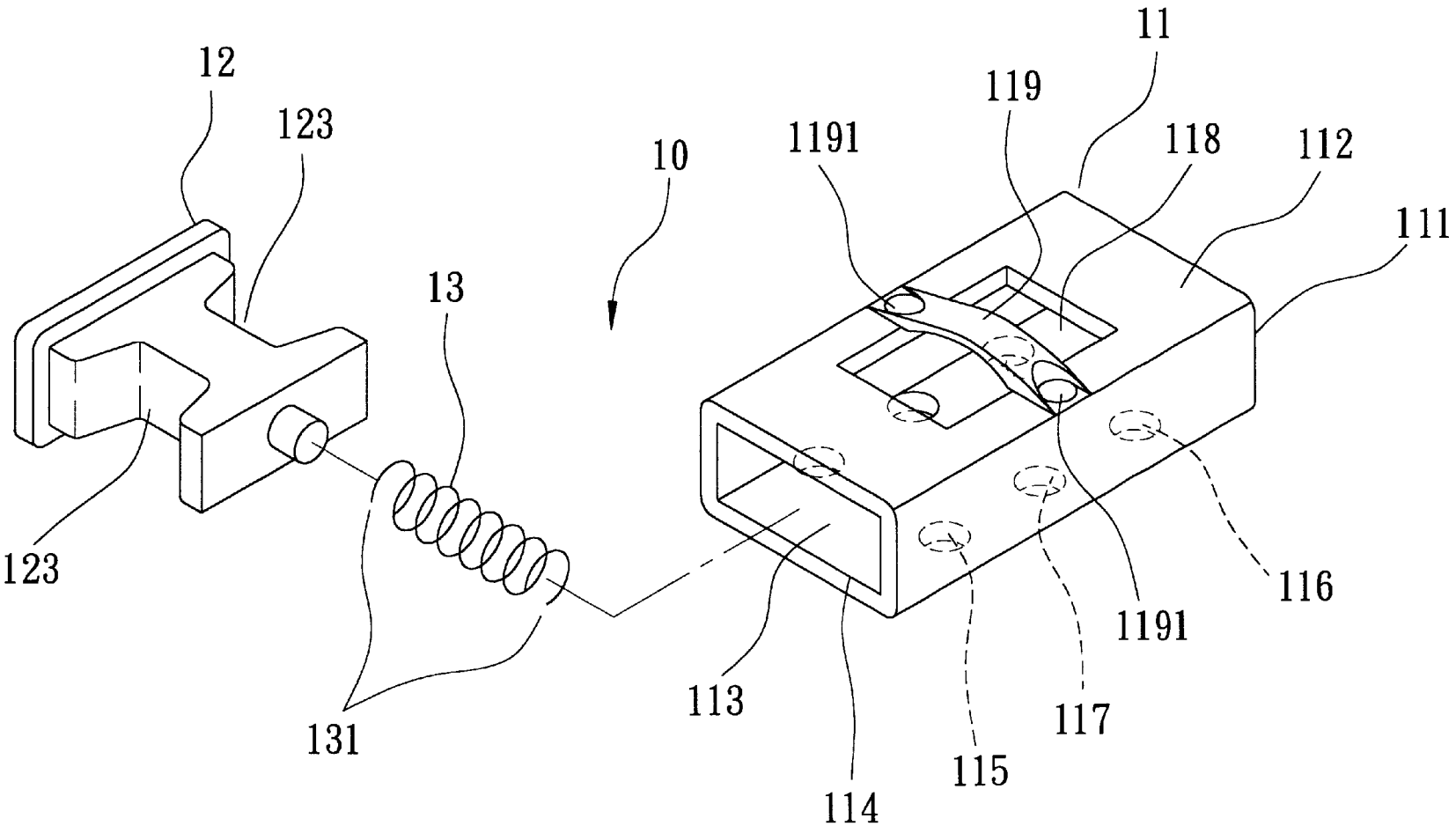
FIG. 4 is an exploded perspective view of a clamp member of the shoe lace device of FIG. 3.

The clamp member 10 is sleeved slidably on medial portions 23, 33 of the first and second lace sections 20, 30 between the upper and lower ends 22, 32, 21, 31 of the first and second lace sections 20, 30. With further reference to FIG. 4, the clamp member 10 includes an elongate casing 11, a clamping block 12, and a biasing member 13. The elongate casing 11 has a lateral open end portion 113, and a closed end portion 111 opposite to the open end portion 113, and includes a lower base plate 114 and an upper cover plate 112 opposite to the lower base plate 114. The upper cover plate 112 is formed with an aperture 118, and has a positioning rib 119 that extends across the aperture 118. The lower base plate 114 is formed with a pair of first lace holes 115, a pair of second lace holes 116, and a pair of third lace holes 117. The positioning rib 119 is formed with a pair of fourth lace holes 1191 that correspond to the third lace holes 117. The medial portions 23, 33 of the first and second lace sections 20, 30 extend through the first lace holes 115 and the aperture 118. The upper ends 42, 52 of the third and fourth lace sections 40, 50 extend through the second lace holes 116 and are formed with a respective knot 421, 521 disposed in the casing 11, thereby anchoring the upper ends 42, 52 of the third and fourth lace sections 40, 50 on the clamp member 10. The lower ends 61, 71 of the fifth and sixth lace sections 60, 70 extend through the aperture 118 to connect with the upper ends 42, 52 of the third and fourth lace sections 40, 50, respectively, thereby anchoring the lower ends 61, 71 of the fifth and sixth lace sections 60, 70 on the clamp member 10. The clamping block 12 is slidably received in the open end portion 113 of the casing 11, and is formed with a pair of vertically extending slot units 123 that correspond to the first lace holes 115 in the lower base plate 114 of the casing 11 for extension of the medial portions 23, 33 of the first and second lace sections 20, 30 therethrough. The biasing member 13, in the form of a coil spring, is disposed in the casing 11, has opposite ends 131 that abut respectively against the clamping block 12 and the closed end portion 111 of the casing 11, and biases the clamping block 12 outwardly of the open end portion 113 of the casing 11, thereby clamping the medial portions 23, 33 of the first and second lace sections 20, 30 between the clamping block 12 and the casing 11, as best shown in FIG. 6.

In the present embodiment, the knots 421, 521, 411, 511 of the upper and lower ends 42, 52, 41, 51 of each of the third and fourth lace sections 40, 50 cooperate to limit a maximum distance of the clamp member 10 from the second eyelet tab 230. One of the first and second loops (I), (II) extends through the other of the first and second loops (I), (II) below the positioning rib 119.

The decorative knot 14 is secured on and is disposed externally of the clamp member 10 between the first and second loops (I), (II). Referring once again to FIG. 3, the decorative knot 14 has a knot portion 142, a pair of distal portions 143 extending from the knot portion 142, and a pair of retaining legs 141. The knot portion 142 is disposed on the positioning rib 119 of the upper cover plate 112. The retaining legs 141 have upper ends 1412 connected to the knot portion 142, and lower ends 1411 that extend through the third and fourth lace holes 117, 1191. A bridging leg 1413 interconnects the lower ends 1411 below the lower base plate 114.

Figure 5:
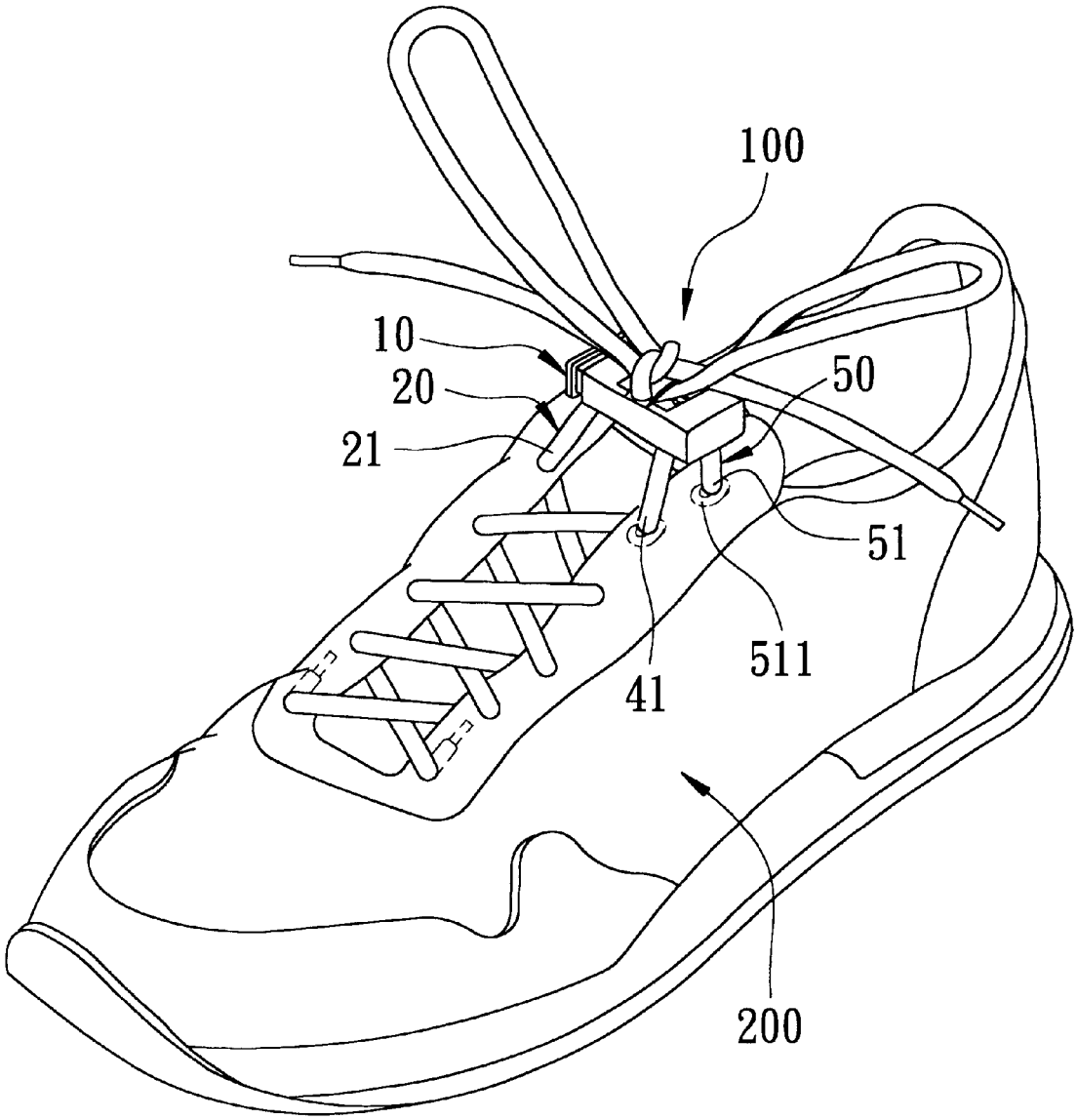
FIG. 5 is a perspective view showing a shoe with the double-bow shoe lace device of the first preferred embodiment in a tightened state.
Figure 6:
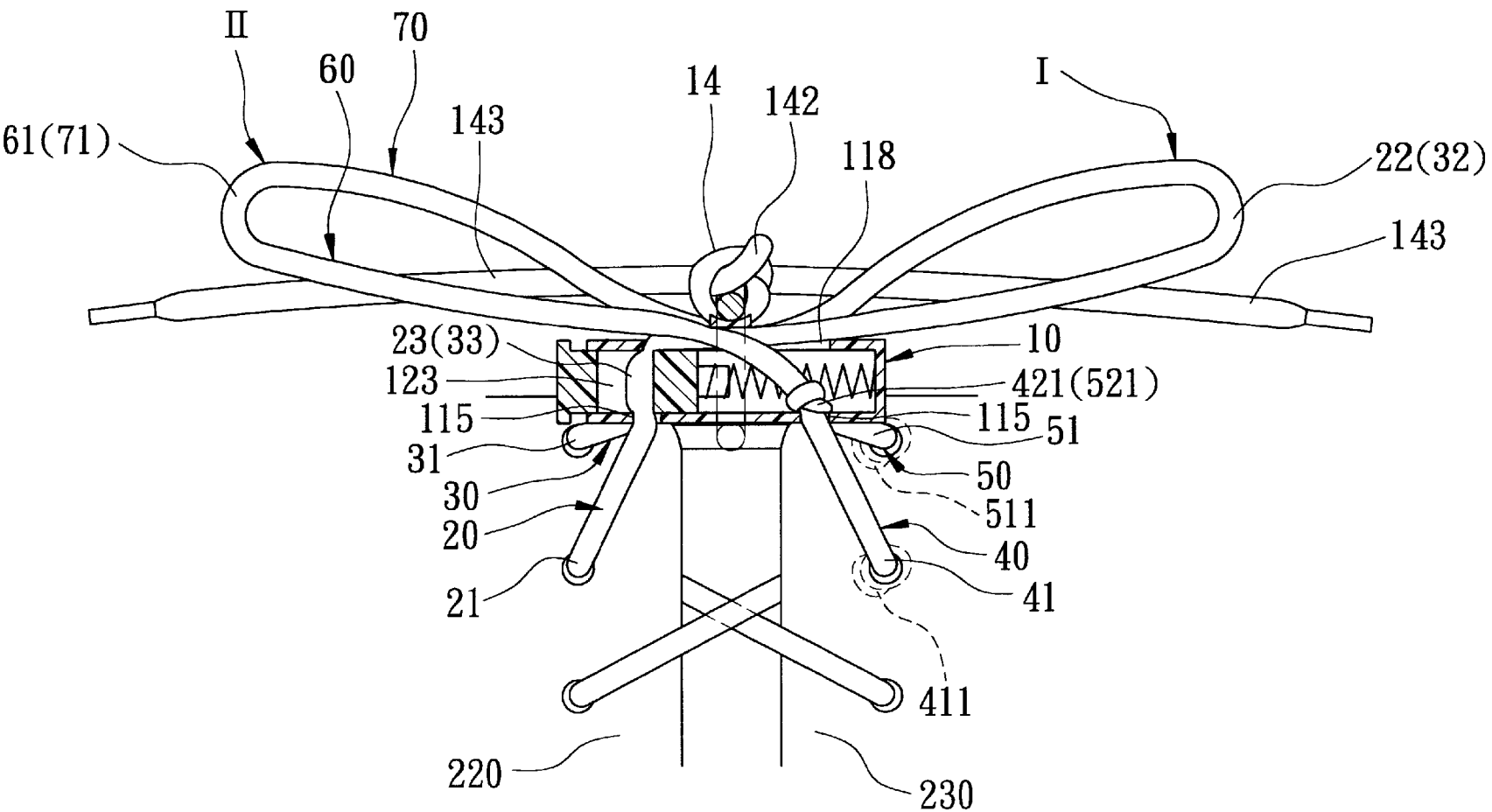
FIG. 6 is a fragmentary cross-sectional view showing how the shoe is tightened upon pulling apart a pair of loops.
Figure 7:
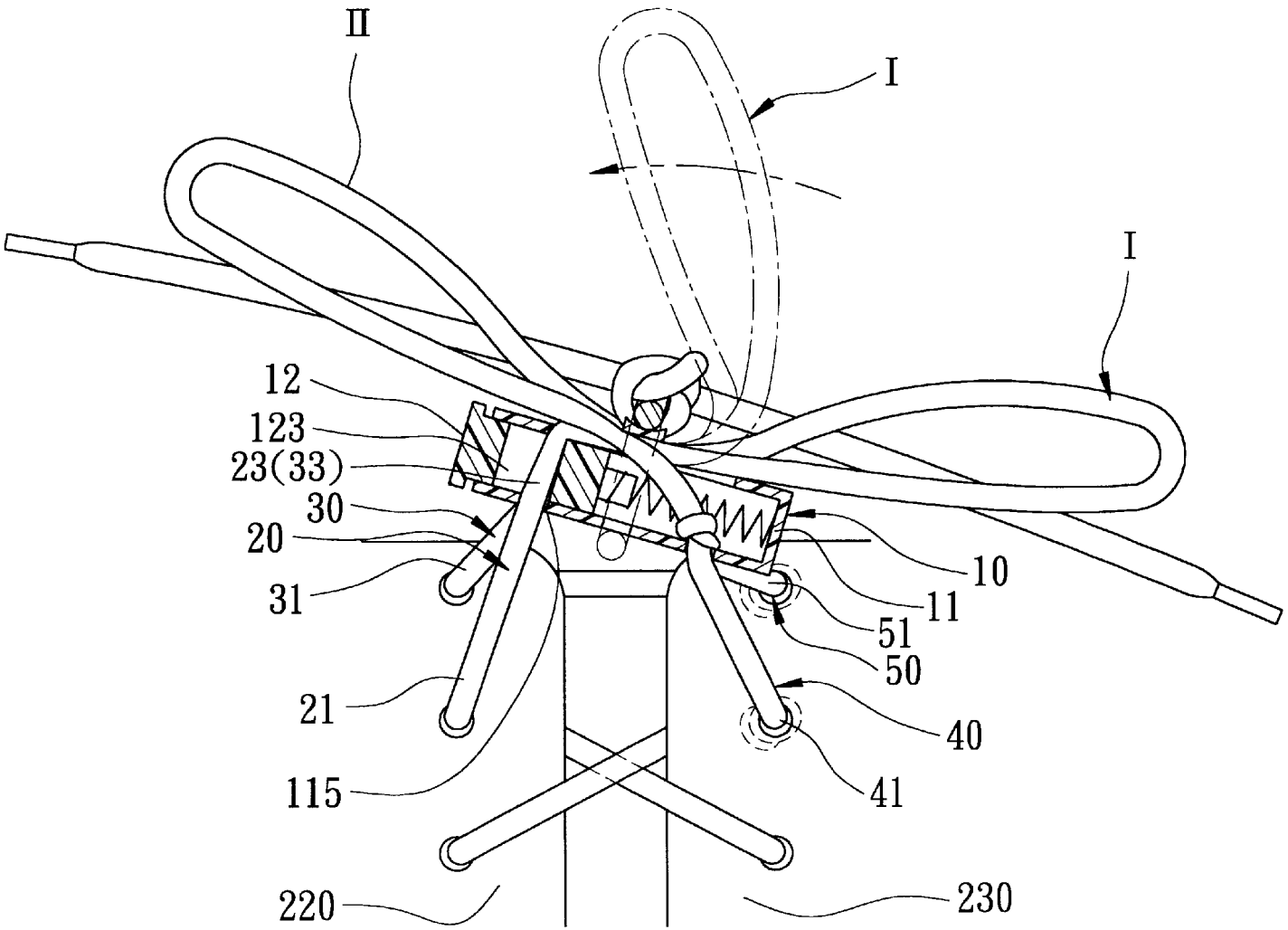
FIG. 7 is a fragmentary cross-sectional view illustrating how movement of the clamp member permits loosening of the shoe.

In use, when the first loop (I) is pulled toward the positioning rib 119, the clamp member 10 will be pushed to slide downwardly along the medial portions 23, 33 of the first and second lace sections 20, 30 to bring the lower ends 21, 31, 41, 51 of the first to fourth lace sections 20, 30, 40, 50 and thus the first and second eyelet tabs 220, 230 closer together for tightening the shoe 200, as illustrated in FIGS. 5 to 7. To loosen the shoe 200, the clamping block 12 is operated to compress the biasing member 13, thereby aligning the slot units 123 with the first lace holes 115, as best shown in FIG. 7. At this time, the clamp member 10 can be slid upwardly along the medial portions 23, 33 of the first and second lace sections 20, 30, thereby permitting the lower ends 21, 31 of the first and second lace sections 20, 30 to move away from each other for loosening the shoe 200.

Therefore, the shoe 200 is not only easy to wear and remove, but also has an attractive appearance in view of the double-bow configuration of the shoe lace device 100.

Figure 8:
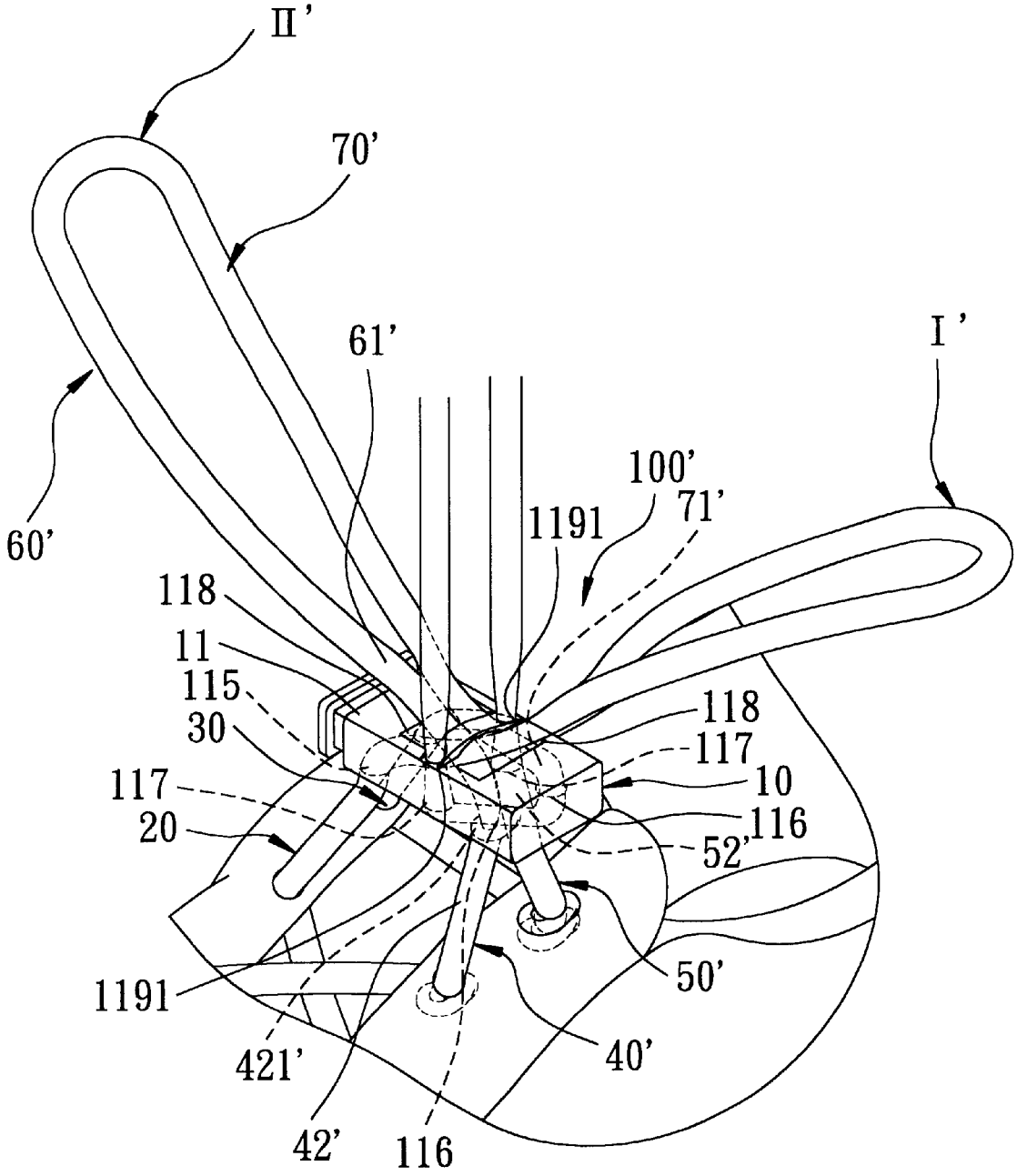
FIG. 8 is a fragmentary view of a shoe that incorporates the second preferred embodiment of a double-bow shoe lace device according to the present invention.
Figure 9:
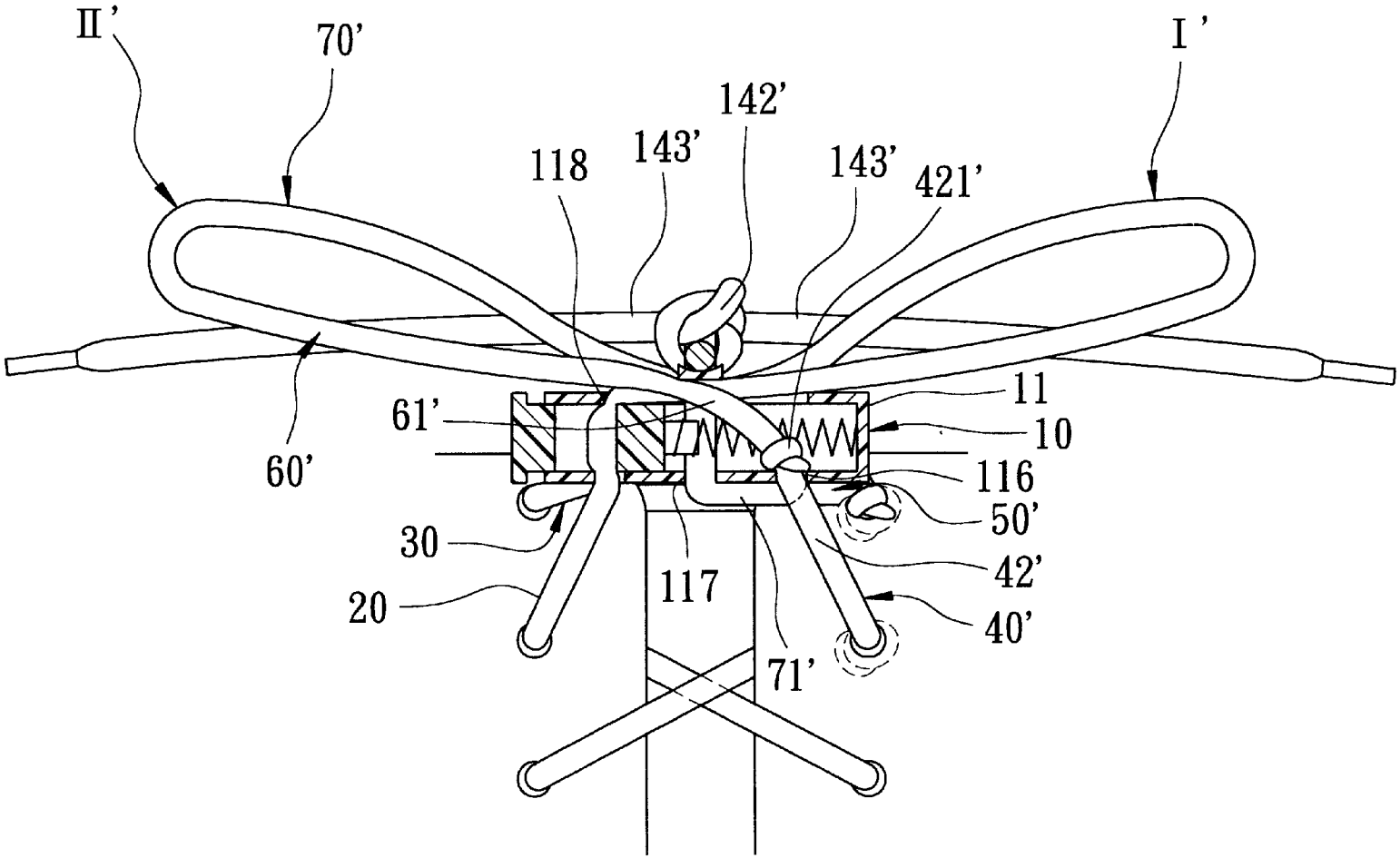
FIG. 9 is a fragmentary cross-sectional view showing how the shoe can be tightened by the shoe lace device of the second preferred embodiment.
Figure 10:
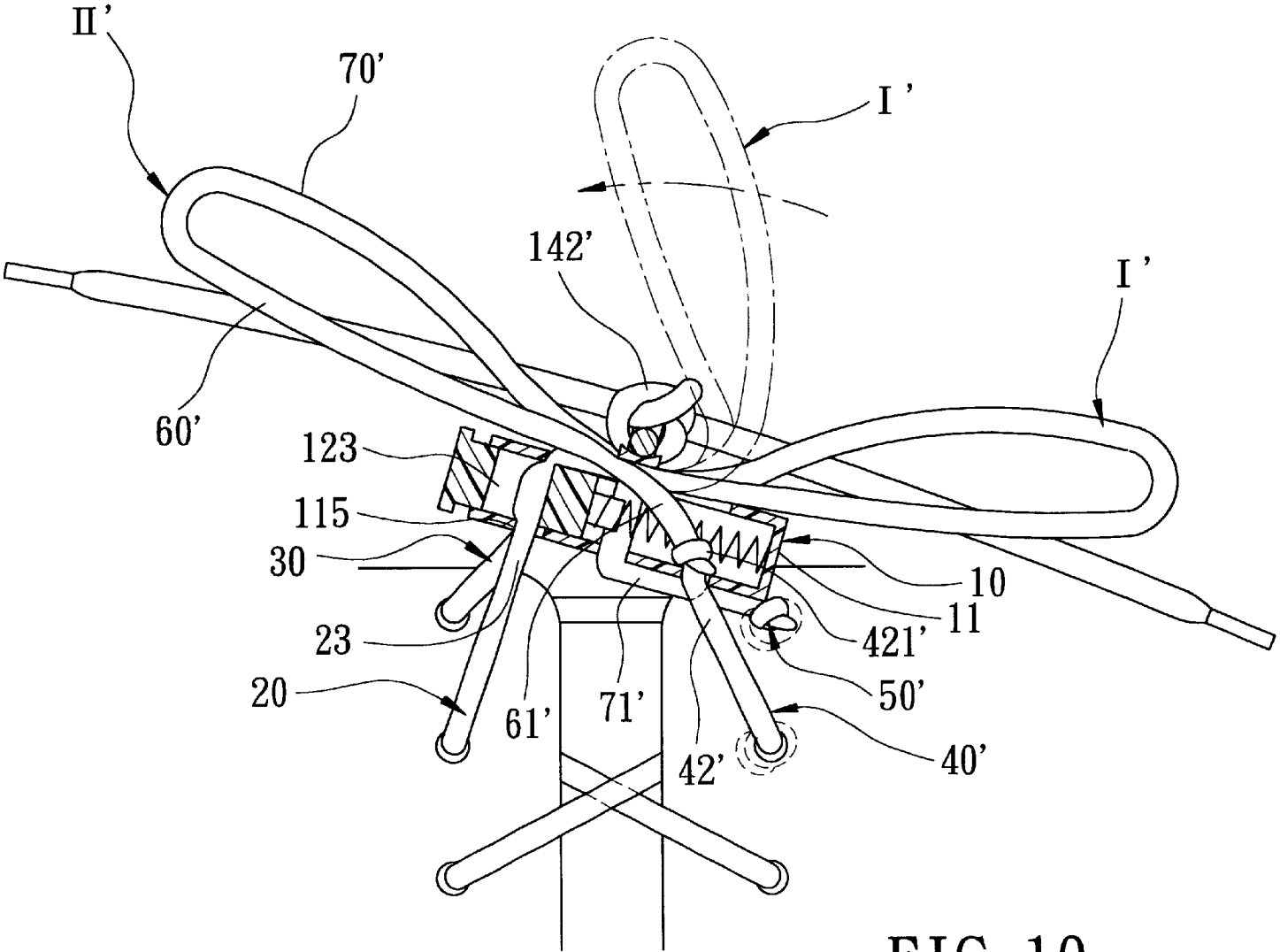
FIG. 10 is a fragmentary cross-sectional view illustrating how movement of the clamp member permits loosening of the shoe.

Referring to FIGS. 8, 9 and 10, the second preferred embodiment of a double-bow shoe lace device 100' according to the present invention is shown to be substantially similar to the first preferred embodiment. In this embodiment, the upper end 42' of the third lace section 40' is formed with a knot 421' for engaging the clamp member 10. The upper end 52' of the fourth lace section 50' is connected to the knot portion 142' of the decorative knot 14'. The lower end 61' of the fifth lace section 60' is connected to the upper end 42' of the third lace section 40'. The lower end 71' of the sixth lace section 70' is connected to the knot portion 142' of the decorative knot 14'. The upper end 42' of the third lace. section 40' extends through one of the second lace holes 116 in the casing 11 of the clamp member 10 such that the knot 421' thereof is disposed in the casing 11. The upper end 52' of the fourth lace section 50' extends through one of the third lace holes 117 to connect with the knot portion 142' of the decorative knot 14'. The lower end 61' of the fifth lace section 60' extends through the aperture 118 to connect with the upper end 42' of the third lace section 40'. The lower end 71' of the sixth lace section 70' extends through the aperture 118, through the other of the second lace holes 116 to extend below the lower base plate 114, and through the other of the third lace holes 117 to connect with the knot portion 142' of the decorative knot 14'. Furthermore, each of the upper end 52' of the fourth lace section 50' and the lower end 71' of the sixth lace section 70' extends through a respective one of the fourth lace holes 1191 of the positioning rib 119 to connect with. the knot portion 142' of the decorative knot 14' above the upper cover plate 112.

The second preferred embodiment operates in a manner substantially similar to that of the first preferred embodiment.

It should be noted that the eyelets through which the first and third lace sections 20, 40 (40') and the second and fourth lace sections 30, 50 (50') extend can be formed to be spaced farther apart, so that the lengths of the third and fourth lace sections 40 (40'), 50 (50') can be increased, thereby allowing greater movement of the clamp member 10 to facilitate the easy wearing and removal of the shoe 200. Alternatively, a pair of hitch members (not shown) could be used instead of the eyelets 260, 270 to anchor removably the lower ends 41, 51 of the third and fourth lace sections 40, 50 onto the eyelet tab 230 of the shoe 200 to facilitate easy wearing and removal of the shoe 200.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A double-bow shoe lace device for a shoe having first and second eyelet tabs, said shoe lace device comprising:

first, second, third, fourth, fifth and sixth lace sections, each of which has a lower end and an upper end;

said lower ends of said first and second lace sections being adapted to be anchored on the first eyelet tab;

said lower ends of said third and fourth lace sections being adapted to be anchored on the second eyelet tab;

said upper ends of said first and second lace sections being interconnected to form a first loop;

said upper ends of said fifth and sixth lace sections being interconnected to form a second loop;

a clamp member sleeved slidably on medial portions of said first and second lace sections between said upper and lower ends of said first and second lace sections;

said upper end of at least one of said third and fourth lace sections being anchored on said clamp member;

said lower ends of said fifth and sixth lace sections being anchored on said clamp member; and a first knot secured on and disposed externally of said clamp member; said first knot being disposed between said first and second loops, and having a knot portion and a pair of distal portions extending from said knot portion, wherein said double-bow shoe lace device can be tightened and loosened without untying said first knot.

2. The double-bow shoe lace device of claim 1, wherein said lower ends of said third and fourth lace sections are formed with a respective second knot that is adapted to engage the second eyelet tab.

3. The double-bow shoe lace device of claim 1, wherein said upper end of each of said third and fourth lace sections is formed with a third knot for engaging said clamp member.

4. The double-bow shoe lace device of claim 3, wherein said lower ends of said fifth and sixth lace sections are connected to said upper ends of said third and fourth lace sections, respectively.

5. The double-bow shoe lace device of claim 4, wherein said clamp member includes:

an elongate casing with a lateral open end portion, and a closed end portion opposite to said open end portion, said casing including a lower base plate, and an upper cover plate opposite to said lower base plate, said upper cover plate being formed with an aperture, said lower base plate being formed with a pair of first lace holes and a pair of second lace holes, said medial portions of said first and second lace sections extending through said first lace holes and said aperture, said upper ends of said third and fourth lace sections extending through said second lace holes such that said knots thereof are disposed in said casing, said lower ends of said fifth and sixth lace sections extending through said aperture to connect with said upper ends of said third and fourth lace sections;

a clamping block slidably received in said open end portion of said casing, and formed with a pair of vertically extending slot units that correspond to said first lace holes in said casing for extension of said medial portions of said first and second lace sections therethrough; and a biasing member disposed in said casing and having opposite ends that abut respectively against said clamping block and said closed end portion of said casing for biasing said clamping block outwardly of said open end portion of said casing, thereby clamping said medial portions of said first and second lace sections between said clamping block and said casing.

6. The double-bow shoe lace device of claim 5, wherein:

said lower base plate further has a pair of third lace holes;

said upper cover plate having a positioning rib that extends across said aperture and that is formed with a pair of fourth lace holes corresponding to said third lace holes;

said knot portion being disposed above said upper cover plate, said first knot further having a pair of retaining legs with upper ends connected to said knot portion and lower ends that extend through said third and fourth lace holes, and a bridging leg that interconnects said lower ends of said retaining legs below said lower base plate.

7. The double-bow shoe lace device of claim 6, wherein one of said first and second loops extends through the other of said first and second loops below said positioning rib.

8. The double-bow shoe lace device of claim 1, wherein said upper end of said third lace section is formed with a third knot for engaging said clamp member, and said upper end of said fourth lace section is connected to said knot portion of said first knot.

9. The double-bow shoe lace device of claim 8, wherein said lower end of said fifth lace section is connected to said upper end of said third lace section, and said lower end of said sixth lace section is connected to said knot portion of said first knot.

10. The double-bow shoe lace device of claim 9, wherein said clamp member includes:

an elongate casing with a lateral open end portion, and a closed end portion opposite to said open end portion, said casing including a lower base plate, and an upper cover plate opposite to said lower base plate, said upper cover plate being formed with an aperture, said lower base plate being formed with a pair of first lace holes, a pair of second lace holes, and a pair of third lace holes, said medial portions of said first and second lace sections extending through said first lace holes and said aperture, said upper end of said third lace section extending through one of said second lace holes such that said knot thereof is disposed in said casing, said upper end of said fourth lace section extending through one of said third lace holes to connect with said knot portion of said first knot, said lower end of said fifth lace section extending through said aperture to connect with said upper end of said third lace section, said lower end of said sixth lace section extending through said aperture, through the other of said second lace holes to extend below said lower base plate, and through the other of said third lace holes to connect with said knot portion of said first knot;

a clamping block slidably received in said open end portion of said casing, and formed with a pair of vertically extending slot units that correspond to said first lace holes in said casing for extension of said medial portions of said first and second lace sections therethrough; and a biasing member disposed in said casing and having opposite ends that abut respectively against said clamping block and said closed end portion of said casing for biasing said clamping block outwardly of said open end portion of said casing, thereby clamping said medial portions of said first and second lace sections between said clamping block and said casing.

11. The double-bow shoe lace device of claim 10, wherein:

said upper cover plate has a positioning rib that extends across said aperture and that is formed with a pair of fourth lace holes corresponding to said third lace holes;

each of said upper end of said fourth lace section and said lower end of said sixth lace section extending through a respective one of said fourth lace holes to connect with said knot portion of said first knot above said upper cover plate.

12. The double-bow shoe lace device of claim 11, wherein one of said first and second loops extends through the other of said first and second loops below said positioning rib.

13. The double-bow shoe lace device of claim 1, wherein said first knot comprises a decorative knot.

* * * * *